US010902693B2

(12) United States Patent
Young

(10) Patent No.: US 10,902,693 B2
(45) **Date of Patent: *Jan. 26, 2021**

(54) MULTICLASS LOGICAL DOCUMENT RECYCLER MANAGEMENT

(71) Applicant: Crane Payment Innovations, Inc., Malvern, PA (US)

(72) Inventor: Neil Young, Dowingtown, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 148 days.

This patent is subject to a terminal disclaimer.

(21) Appl. No.: 15/943,508

(22) Filed: Apr. 2, 2018

(65) Prior Publication Data

US 2018/0225904 A1 Aug. 9, 2018

Related U.S. Application Data

(63) Continuation of application No. 14/575,746, filed on Dec. 18, 2014, now Pat. No. 9,934,642.

(51) Int. Cl.
*G07D 11/24* (2019.01)
*G07D 11/25* (2019.01)

(52) U.S. Cl.
CPC ..... *G07D 11/24* (2019.01); *G07D 11/25* (2019.01)

(58) Field of Classification Search
CPC ..... G07D 11/0051; G07D 11/0054; G07D 11/0057; G07D 11/006; G07D 11/0063; G07D 11/0066; G07D 11/0069; G07D 11/0072; G07D 11/0075; G07D 11/25; G07D 11/237; G07D 11/20; G07D 11/24; G07D 11/245; G07D 11/26; G07D 11/30; G07D 11/32; G07D 11/34; G07D 11/36;
(Continued)

(56) References Cited

U.S. PATENT DOCUMENTS 5,553,320 A 9/1996 Matsuura et al.
6,170,822 B1 1/2001 Kato et al.
(Continued)

FOREIGN PATENT DOCUMENTS

CN 102272801 A 12/2011
DE 102006058549 A1 6/2008
(Continued)

OTHER PUBLICATIONS

International Search Report and the Written Opinion of the International Searching Authority for PCT Patent Application No. PCT/US2015/066433 dated Mar. 11, 2016; 11 pages.

*Primary Examiner* — Jeffrey A Shapiro

(57) ABSTRACT

A document handling apparatus for recycling documents includes an authentication unit, a first recycling storage unit, a document cassette, and a controller. The authentication unit is for receiving an input document and classifying the input document as having a class that is one of a plurality of classes. The first recycling storage unit is adapted to store documents belonging to two or more of the plurality of classes. The document cassette is adapted to store received documents. The controller is adapted to direct the input document to one of the document cassette and the first recycling storage unit based on content of the first recycling storage unit and the class of the input document. Related apparatus, systems, techniques, and articles are also described.

18 Claims, 10 Drawing Sheets

(58) Field of Classification Search
CPC ..... B65H 29/12; B65H 29/125; B65H 29/14; B65H 29/145; B65H 29/08; B65H 29/006; B65H 29/008; B65H 2701/1912
USPC ..... 194/206, 207; 209/534; 382/135; 235/379
See application file for complete search history.

(56) References Cited

U.S. PATENT DOCUMENTS

| | | | | |
|---|---|---|---|---|
| 6,371,473 | B1 | 4/2002 | Saltsov et al. | |
| 6,422,458 | B1 | 7/2002 | Katou et al. | |
| 6,510,985 | B1 * | 1/2003 | Clark | G07D 11/12 235/379 |
| 7,000,778 | B2 | 2/2006 | Omori et al. | |
| 7,434,725 | B2 | 10/2008 | Taniyama | |
| 7,520,375 | B2 | 4/2009 | Ina et al. | |
| 8,100,395 | B2 | 1/2012 | Afanasav et al. | |
| 8,376,116 | B2 | 2/2013 | Robinson et al. | |
| 8,602,200 | B2 | 12/2013 | Bake | |
| 2002/0079361 | A1 * | 6/2002 | Kosugi | B65H 1/025 235/379 |
| 2002/0088850 | A1 | 7/2002 | Katou et al. | |
| 2002/0198839 | A1 | 12/2002 | Uozumi et al. | |
| 2004/0015439 | A1 | 1/2004 | Taniyama | |
| 2004/0093117 | A1 * | 5/2004 | Daout | G07D 11/245 700/231 |
| 2004/0256450 | A1 | 12/2004 | Fujioka | |
| 2005/0056519 | A1 | 3/2005 | Yokoi et al. | |
| 2006/0097444 | A1 | 5/2006 | Spinetti | |
| 2006/0169623 | A1 | 8/2006 | Razzaboni et al. | |
| 2008/0060906 | A1 | 3/2008 | Fitzgerald et al. | |
| 2008/0142583 | A1 | 6/2008 | Yokoi et al. | |
| 2009/0229947 | A1 | 9/2009 | Takai et al. | |
| 2009/0236797 | A1 | 9/2009 | Kitagawa et al. | |
| 2010/0025911 | A1 | 2/2010 | Sakamoto | |
| 2010/0198396 | A1 * | 8/2010 | Brexel | G07D 11/25 700/219 |
| 2011/0169210 | A1 | 7/2011 | Nagura et al. | |
| 2011/0259707 | A1 * | 10/2011 | Young | G07D 11/20 194/342 |
| 2012/0103754 | A1 | 5/2012 | Robinson et al. | |
| 2012/0261874 | A1 | 10/2012 | Arikata et al. | |
| 2013/0001039 | A1 | 1/2013 | Mizushima et al. | |
| 2013/0001040 | A1 | 1/2013 | Iwamura et al. | |
| 2013/0041809 | A1 * | 2/2013 | Ino | G07C 9/00912 705/39 |
| 2013/0046407 | A1 * | 2/2013 | Tomizawa | G07F 19/202 700/215 |
| 2013/0186729 | A1 | 7/2013 | Miksic et al. | |
| 2013/0248320 | A1 | 9/2013 | Tomizawa | |
| 2014/0060997 | A1 | 3/2014 | Doi et al. | |
| 2014/0069770 | A1 | 3/2014 | Nomura | |
| 2014/0144750 | A1 | 5/2014 | Shimizu et al. | |
| 2015/0213667 | A1 | 7/2015 | Chugo | |

FOREIGN PATENT DOCUMENTS

| | | | |
|---|---|---|---|
| EP | 1997081 | A1 | 12/2008 |
| EP | 2350990 | B1 | 4/2014 |
| WO | 2004077365 | A2 | 9/2004 |
| WO | 2010036693 | A1 | 4/2010 |

* cited by examiner

500

600

800

| # per trans | $5 | $10 | $20 |
|---|---|---|---|
| 1 | 77% | 90% | 59% |
| 2 | 94% | 97% | 79% |
| 3 | 97% | 99% | 86% |
| 4 | 99% | 100% | 90% |
| 5 | 99% | 100% | 92% |
| 6 | 99% | 100% | 94% |
| 7 | 99% | 100% | 96% |
| 8 | 100% | 100% | 96% |

*FIG. 8*

MULTICLASS LOGICAL DOCUMENT RECYCLER MANAGEMENT

CROSS-REFERENCE TO RELATED APPLICATION

This application is a continuation of U.S. patent application Ser. No. 14/575,746 filed Dec. 12, 2014, which is hereby incorporated by reference in its entirety.

TECHNICAL FIELD

The subject matter described herein relates to management and operation of a multiclass logical document recycler for use with documents such as, for example, currency.

BACKGROUND

Self-checkout (SCO) machines provide a mechanism for customers to process their own purchases from a retailer. They are an alternative to the traditional cashier-staffed checkout. In practice, the customer assumes the job of the cashier by scanning and applying payment for the items themselves.

When a customer pays at a self-checkout machine using cash, the self-checkout machine must accept the cash and in most cases, provide change in the form of cash. In order to provide this functionality, some self-checkout machines have large amounts of stored cash for providing change and a separate capacity for receiving cash payment. Some self-checkout machines can provide multiple denominations as change from a single storage compartment but sorting through the multiple denominations to provide correct change can introduce significant delay into the transaction.

SUMMARY

In an aspect, a document handling apparatus for recycling documents includes an authentication unit, a first recycling storage unit, a document cassette, and a controller. The authentication unit is for receiving an input document and classifying the input document as having a class that is one of a plurality of classes. The first recycling storage unit is adapted to store documents belonging to two or more of the plurality of classes. The document cassette is adapted to store received documents. The controller is adapted to direct the input document to one of the document cassette and the first recycling storage unit based on content of the first recycling storage unit and the class of the input document.

In another aspect, a document handling apparatus for dispensing documents includes a document dispensing unit, a first recycling storage unit, a document cassette, and a controller. The document dispensing unit is for dispensing an output document. The output document has a class that is one of a plurality of classes. The first recycling storage unit is adapted to store documents belonging to two or more of the plurality of classes. The document cassette adapted to store documents. The controller is adapted to cause modification of an arrangement of the documents stored on the first recycling storage unit in response to dispensing the output document.

In yet another aspect, an input document can be received having a class that is one of a plurality of classes. Whether to direct the input document to a document cassette or a first recycling storage unit can be determined using a controller comprising at least one data processor forming part of at least one computing system. The determination can be based on an arrangement of the first recycling storage unit and the class of the input document. The input document can be transported to one of the document cassette and the first recycling storage unit.

One or more of the following features can be included in any feasible combination. For example, the first recycling storage unit can be adapted for two-way document transportation and the document cassette can be adapted for one-way document transportation. The controller can direct the input document after reception by the authentication unit and before storage of the input document. The controller can be further adapted to cause modification of an order of at least two leading documents on the first recycling storage unit based on classes of the at least two leading documents. The controller can cause modification of the order after reception of the input document by the authentication unit and before storage of the input document in a document storage unit. The controller can be further adapted to cause modification of an arrangement of the documents stored on the first recycling storage unit based on a distribution of classes of the documents on the first recycling storage unit. The controller can be further adapted to cause modification of an arrangement of the documents stored on the first recycling storage based on a present arrangement of the documents and according to a defined set of criteria. The controller can be adapted to define the set of criteria using historical transaction data of the document handling apparatus. The historical transaction data can characterize input and output of documents over a time.

A second recycling storage unit and a transportation unit can be included. The transportation unit can be operatively coupled to the authentication device, the second recycling storage unit, and the first recycling storage unit. The transportation unit can be adapted to transport documents between the authentication unit and at least one of the first recycling storage unit and the second recycling storage unit. The transportation unit can be further adapted to transport documents between the first recycling storage unit and the second recycling storage unit. The controller can be further adapted to cause modification of an arrangement of the documents stored on the first recycling storage unit based on a distribution of classes of the documents on the first recycling storage unit. The second recycling storage unit can be adapted to store received documents. Modification of the arrangement of the documents stored on the first recycling storage unit can be performed by one of transporting documents between the first recycling storage unit, the second recycling storage unit, and the document cassette.

The first recycling storage unit can be adapted for two-way document transportation and the document cassette can be adapted for one-way document transportation. The arrangement of the documents stored on the first recycling storage unit can be modified based on a present arrangement of the documents and according to a predefined set of criteria.

The determination can be performed after receiving the input document and before storage of the input document. The first recycling storage unit can store documents in a last-in-first-out queue. An order of at least two leading documents can be modified on the first recycling storage unit based on classes of the at least two leading documents.

Computer program products are also described that comprise non-transitory computer readable media storing instructions, which when executed by at least one data processor of one or more computing systems, causes at least one data processor to perform operations herein. Similarly, computer systems are also described that may include one or more data processors and a memory coupled to the one or more data processors. The memory may temporarily or permanently store instructions that cause at least one processor to perform one or more of the operations described herein. In addition, methods can be implemented by one or more data processors either within a single computing system or distributed among two or more computing systems.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

FIG. 8 is a chart illustrating the cumulative percentages illustrated in FIG. 7;

Like reference symbols in the various drawings indicate like elements.

DETAILED DESCRIPTION

The subject matter described herein enables management of the content of multiple classes of documents on a document recycler. The current subject matter can, when a document is received, determine whether to direct the document to a two-way recycler (capable of providing change) or a one-way cassette (not capable of providing change) based on the content of the two-way recycler and a class (e.g., denomination) of the document. Additionally, an arrangement of the documents on the two-way recycler can be modified. The modification can occur, for example, when a document is to be provided (e.g., dispense change) or when a document is received to prepare the recycler to provide change at a later time. This can be performed, for example, so that change can be quickly provided to a user (e.g., the user does not have to wait significant amounts of time to receive change).

Documents can include, for example, banknotes, bills, checks, valuable papers, currency, coins, tokens, certificates, coupons, tickets, valuable items, and the like.

Figure 1:
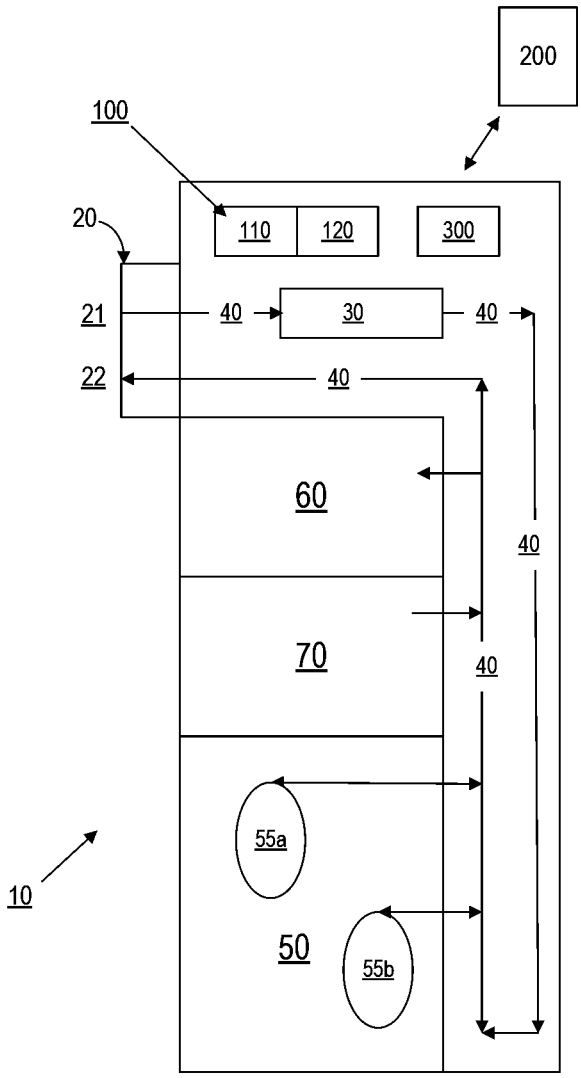
FIG. 1 is an example implementation of a document handler configured to manage content of multiple classes of documents on a document recycler.

FIG. 1 is an example implementation of a document handler 10 configured to manage content of multiple classes of documents on a document recycler. In the implementation of FIG. 1, the document handler 10 can include a document inlet/outlet 20 for receiving documents, an authentication unit 30 for authenticating documents, a transportation mechanism 40 for transporting documents to and from various components within the money handler 10, and one or more document storage units 50 capable of receiving, storing, and dispensing documents. Authentication unit 30 can classify input documents as having a class that is one of several classes (e.g., determining a denomination of the document). In some implementations, document handler 10 can further include a document cassette 60 (e.g., cashbox or cash bag) for receiving and storing documents. Document cassette 60 can be a one-way storage device for documents such that document handler 10 cannot extract documents contained in the document cassette 60.

Document handler 10 can further include a controller 100 for controlling the overall operation of the money-handling unit. Controller 100 can include a microprocessor 110 and memory 120 for processing and storing instructions to operate document handler 10. Controller 100 can be adapted to determine how each inserted banknote is handled (e.g., where it should be stored or whether it should be returned to the user), and for controlling components of the document handler 10 (e.g., components 30, 40, 50, 60, and/or 70) coupled thereto to accomplish movement of documents into, through and out of document handler 10.

The document storage unit 50 can be mounted to document handler 10 and can include a first recycler drum 55*a* (e.g., two-way storage) and a second recycler drum 55*b* (e.g., two-way storage). In some implementations, each recycling drum 55*a* and/or 55*b* can be configured so that documents are stored on the recycling drum 55*a* and/or 55*b* in a definite order such as in a queue and removed from the queue according to the definite order. For example, a recycler drum can be configured for last-in-first-out (LIFO) storage, first-in-first-out (FIFO) storage, and the like. In some implementations, there can be a need for a large capacity of a predetermined class of documents (e.g., 1 dollar bills) because consumer input is generally less than the required change output, so the first drum 55*a* can store and recycle exclusively the predetermined class of document (e.g., 1 dollar bills). The second drum 55*b* can manage the documents in the remaining classes (e.g., 5 dollar, 10 dollar, and 20 dollar bills). Documents selected to be stored within storage unit 50 can be received from transportation mechanism 40 for later user as change in a transaction. Documents stored within document storage unit 50 can be dispensed therefrom to transportation mechanism 40 for further processing by document handler 10.

In some implementations, the controller 100 can manage the content, order, arrangement, and/or distribution of the documents within the recycler drums 55*a* and 55*b* (e.g., within the queue and so that documents can be dispensed within a reasonable time). In operation, when a user inserts a document into document handler 10, the authentication unit 30 can receive the input document and classify the input document. The controller 100 can direct the input document to either the document cassette 60 (e.g., the one-way storage unit) or one of the recyclers 55*a* and 55*b* based on the content of one or more of the recyclers 55*a* and 55*b* and the class of the input document. For example, if a document of a high-denomination class is received as the input document, then the controller 100 can determine whether there are a sufficient number of high-denomination documents on the recycler drum 55*b*, and whether there is a sufficient number (e.g., too many) high-denomination documents near the output of the queue (e.g., within a predetermined range of positions relative to the front of the queue). If there are too many high-denomination documents either on the recycler drum 55*b* or near the front of the queue, then the controller 100 can direct the input document to the document cassette 60 for storage. Otherwise, the controller 100 can direct the input document to the recycler drum 55*b* for storage in the queue.

The controller 100 can also be adapted to cause modification of an order of the queue on the recycler drum 55*b* based on the classes of the leading documents in the queue (e.g., the documents near the front of the queue). For example, the controller 100 can reorder the queue by utilizing an escrow process with the first recycler drum 55*a* and/or by sending documents to the document cassette 60 to place the low-denomination classes nearer to the front of the queue (e.g., into leading positions). The controller 100 can then subsequently store the input document on the recycler drum 55*b*.

Figure 2:
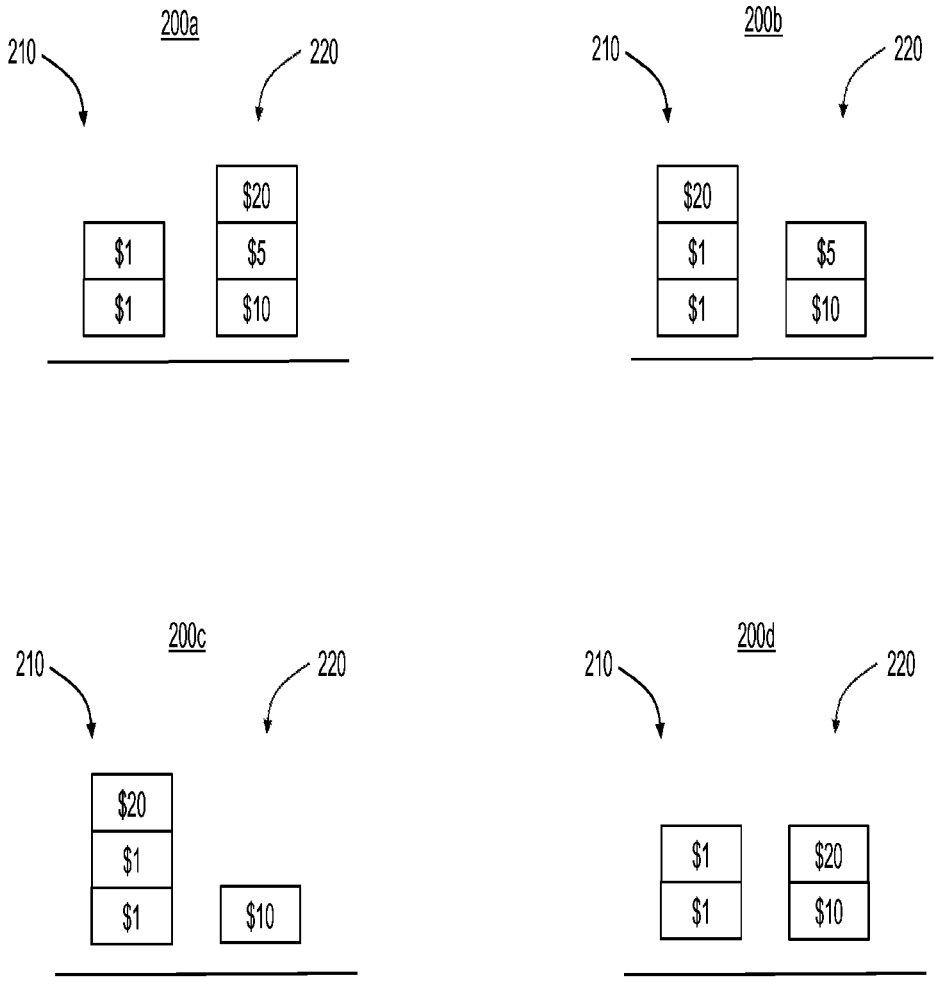
FIG. 2 is a series of diagrams illustrating an escrow process between two logical document recyclers.

The controller 100 can use an escrow process to move documents from one recycler drum to another to circumvent the queue configuration (e.g., LIFO). For example, FIG. 2 is a series of diagrams (200*a*-200*d*) illustrating an escrow process between two logical document recyclers (e.g., recycler drums 55*a* and 55*b*). In the illustrated implementation, the documents are banknotes and the logical document recyclers have a logical LIFO queue (also referred to as a logical "stack"). At 200*a*, the first recycler queue 210 stores exclusively $1 document and the second recycler queue 220 contains a $20 document in the front (or top) position, a $5 document in a second-to-front position, and a $10 document in the third-to-front position. The $20 document can be moved from the second recycler queue 220 to the first recycler queue 210, for example, as shown at 200*b*. The $5 document is now in the front position of the second recycler queue 220. The $5 document can then be dispensed as shown, for example, at 200*c*. The $20 document can then be transported back to the second logical recycler queue 220. Thus, the first logical recycler can serve as an escrow for dispensing documents from the second logical recycler in any desired sequence. In some implementations, at least a portion of the capacity of one of the recycler drums 55*a* and 55*b* can be reserved for escrow.

Document cassette 60 can also be utilized for circumventing the queue configuration (e.g., LIFO) of the recycler storage drums 55*a* and 55*b*. For example, in the implementation in which the documents are banknotes and the second recycler drum 55*b* contains a $20 document in the front position and a $5 document in a second-to-front position in a LIFO queue, the document handler 10 can move the $20 document to the document cassette 60, then dispense the $5 document to a user. Because the document cassette 60 is a one-way storage unit, the $20 document remains in the document cassette 20 and may not return to the second recycler drum 55*b*.

While it is possible to circumvent the queue characteristic (e.g., LIFO, FIFO, and the like) of the recycling drums 55*a* and 55*b*, moving a document between storage units (e.g., such as during an escrow procedure) can add time (e.g., in an implementation, 1 or more second is added per moved document) to the process of dispensing a document. In addition, in most transactions and in the example implementation where documents are banknotes or items of currency, the denomination (e.g., class) of the banknote provided as input is more likely to be a high denomination (e.g., $20 documents) while the denomination of document being dispensed is of a lower denomination (e.g., $1 and $5 documents). So the "last-in" document on a LIFO recycler is likely to be a high denomination document (e.g., $20) whereas the recycler is likely required to dispense a low denomination document (e.g., $1 and $5). Over several transactions, the leading lower denomination document migrates towards the rear of the queue requiring more and more documents to undergo escrow for dispensing to occur. This can lead to successively increasing transaction times.

Direction of the input document and/or modification of the queue can occur after validation and/or before the document is stored in any storage component so that management is performed in substantially "real-time" or at time-of-transaction, which may reduce the processing time required to move documents between storage units. In some implementations, direction of the input document and/or modification of the queue can occur before a transaction completes. In addition, the modification of the queue can occur prior to dispensing a document (e.g., an output document), for example, as change in a transaction or for a "cash-back" feature.

The directing of the input document and/or modification of the queue by the controller 100 can occur based on queue content, for example, one or more of a queue class quota (e.g., whether a maximum or sufficient amount of documents are present in the queue), queue order/arrangement (e.g., the order of the queue, such as, requiring a low denomination class to be in the first and/or second position and ready for dispensing), and/or distribution of the documents within the queue (e.g., whether classes are evenly distributed throughout the queue).

Moreover, a set of criteria can be predefined and/or predetermined for directing the input document and/or modification of the queue. The predefined criteria can include one or more rules (e.g., forming a rule set) defining conditions for directing the input document and/or modifying the queue. The rules can reflect document supply and demand (e.g., rates at which different classes are input and dispensed during a series of transaction). The criteria and/or rules can be predefined, for example, using a database of historical transaction data to determine optimal rules for directing input bills and modifying the storage queue. In some implementations, the criteria and/or rules can be developed adaptively while the document handler 10 is deployed. The criteria and/or rules can be developed adaptively using machine learning (for example, support vector machines, neural networks, clustering, and the like) over operation of the document handler 10. Thus the document handler 10 can adapt the criteria and/or rules based on the particular application and transaction requirements that the document handler 10 experiences.

Referring again to FIG. 1, in some implementations, inlet/outlet 20 is coupled to transportation mechanism 40 such that documents inserted into inlet/outlet 20 are received by the transportation mechanism 40. Inlet/outlet 20 can be configured to accept a wide variety of documents having various widths and other dimensions. In some implementations document handler 10 can include separate openings for receiving and dispensing documents. For example, a document inlet 21 is for receiving at least one document from a user and document outlet 22 can be for dispensing at least one document.

In some implementations, inlet 21 and/or outlet 22 can be configured to handle a bundle of documents at one time. More specifically, a user may provide a stack of documents to document handler 10 via document inlet 21. The stack of documents can be received by unit 10 where each document is fed by transportation mechanism 40 to authentication unit 30 one at a time.

In some implementations, authentication unit 30 uses an optical sensing unit to discriminate the document (e.g., to discriminate between genuine vs. non-genuine items, or to classify the items) and determine other characteristics of the document (e.g., condition, degree of soiling, rips, tears, holes, and the like). The optical sensing unit can be of any type (e.g., spectral reflection and/or transmission). Alternatively, the sensing unit can be any other type of document sensing system (e.g., magnetic sensing, physical sensing, and the like). Authentication unit 30 can be configured to sense and discriminate documents and/or it can be arranged to provide sensed data to a controller 100 for further processing.

In some implementations, transportation mechanism 40 can operatively couple inlet/outlet 20 to the authentication unit 30. Transportation mechanism 40 can include a series of belts driven by an actuator to cause documents to move in an inward and outward direction relative to the entry and exit of the document handler 10. Transportation mechanism 40 can be further coupled to document storage unit 50 for transporting documents to and from the document storage unit 50 based on the desired operation of document handler 10. In some implementations, transportation mechanism 40 can include one continuous transportation path arranged to move in forward or backward motion (or capable of moving in both the forward and backward directions). In other implementations, transportation mechanism 40 can be comprised of a series of smaller transportation units to create a continuous transportation path. Other types of transportation mechanisms can be adapted for use within the document handler 10.

In some implementations, document cassette 60 can be configured to store documents identified by the document handler 10 to be held within document cassette 60 for later removal by an authorized individual. In some implementations, documents stored in the document cassette 60 have to be removed from the document cassette 60 when it is external to the document handler 10.

In some implementations, a loading unit 70 can be included for providing at least one item of currency to the document handler 10 for use as change in a transaction. Loading unit 70 can be removably mounted to document handler 10 and can be operatively coupled to transportation mechanism 40. Loading unit 70 can be configured as a one-way storage device for documents such that the document handler 10 can extract documents contained in the loading unit 70 but cannot store documents in the document loading unit 70.

Loading unit 70 can be adapted to have documents inserted therein at a location (e.g., banking center) remote from document handler 10. Loading unit 70 can be configured to house either a single class of documents (e.g., 5 dollar documents) or multiple classes of documents (e.g., 5 dollar, 10 dollar, and 20 dollar documents) and supply its contents to document handler 10. Once loading unit 70 is inserted into document handler 10 by an authorized individual, controller 100 can then instruct loading unit and transportation mechanism 40 to extract the contents of the loading unit. Each banknote dispensed from loading unit 70 can be transported to authentication unit 30 to verify at least one of its validity, class, or condition. Based on the results obtained from authentication unit 30, document handler 10 can send each document to a respective storage unit.

In some implementations, document storage unit 50 is arranged to store documents in a stacked (e.g., face-to-face) manner. In some implementations, document storage unit 50 can be removably mounted to document handler 10.

In some implementations, controller 100 includes an external access for communicating with an external component 200 (e.g., handheld service tool or remote computer). In other implementations, document handler 10 includes a communications unit 300 for communicating with remote devices for receiving updates and/or service information.

Figure 3:
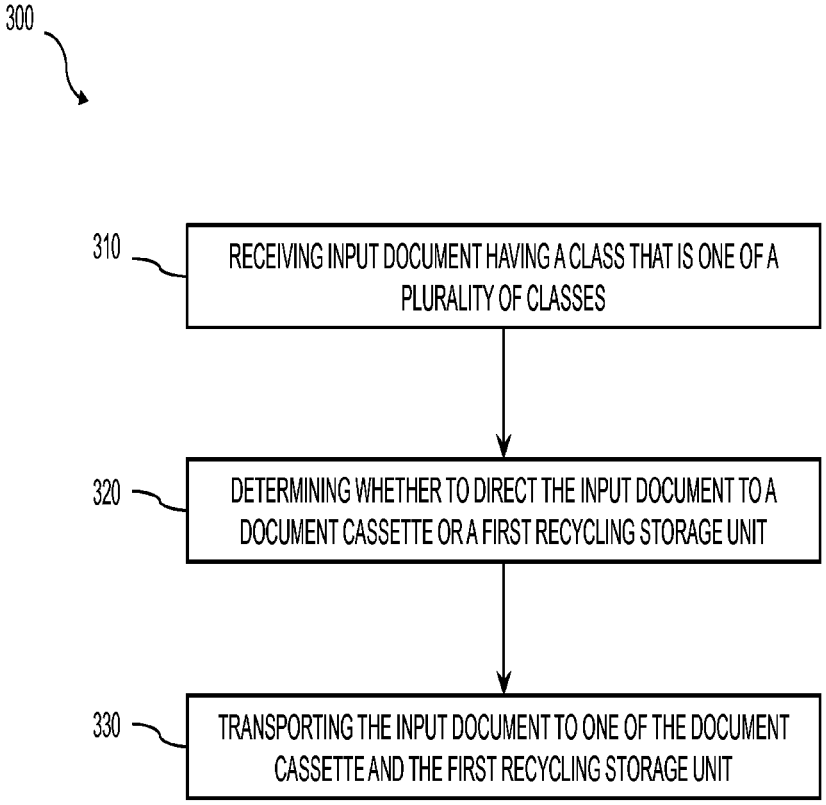
FIG. 3 is a process flow diagram illustrating a method of managing the content of a logical document recycler.

FIG. 3 is a process flow diagram 300 illustrating a method of managing the content of a logical document recycler. An input document, at 310, can be received. The input document can have a class that is one of a plurality of classes. Whether to direct the input document to a document cassette or a first recycling storage unit, at 320, can be determined. The determination can be based on an arrangement of the contents of the first recycling storage unit, for example, a queue of the first recycling storage unit, and the class of the input document. The input document, at 330, can be transported to one of the document cassette and the first recycling storage unit.

Figure 4:
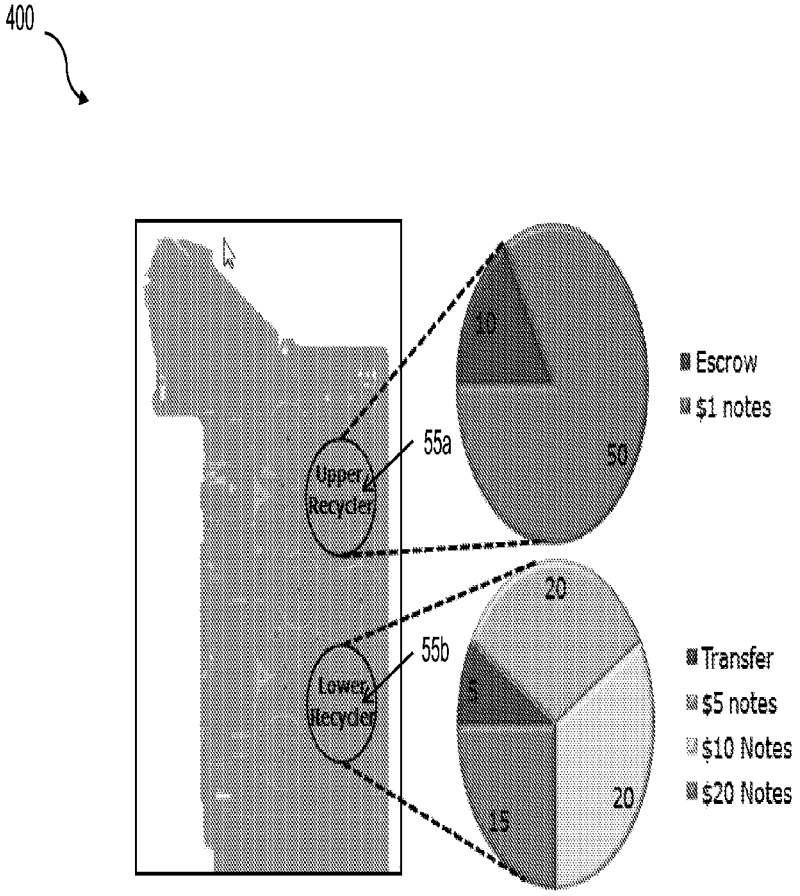
FIG. 4 is an illustration of a logical partitioning of recycling drums in an implementation of a document handler configured to manage the content of the recycling drums.

FIG. 4 is an illustration of a logical partitioning of recycling drums 55*a* and 55*b* in an example implementation of a document handler 10 configured to manage the content of the recycling drums 55*a* and 55*b*. In the illustrated implementation, each recycling drum 55*a* and 55*b* can store a maximum of 60 documents. The first recycling drum 55*a* can store up to 50 one-dollar notes and have capacity to hold up to ten notes in escrow. The second recycling drum 55*b* can be logically partitioned such that the drum contains 20 $5 documents, 20 $10 documents, and 15 $20 documents. Although FIG. 4 illustrates a logical division among the different classes of documents, the actual documents classes can be generally co-mingled throughout the recycler drum queue. Moreover, because document recyclers have a limited capacity, the amount of each class of documents stored on the document recyclers can be adjusted to reflect ongoing demand for dispensing documents of different classes.

Figure 5:
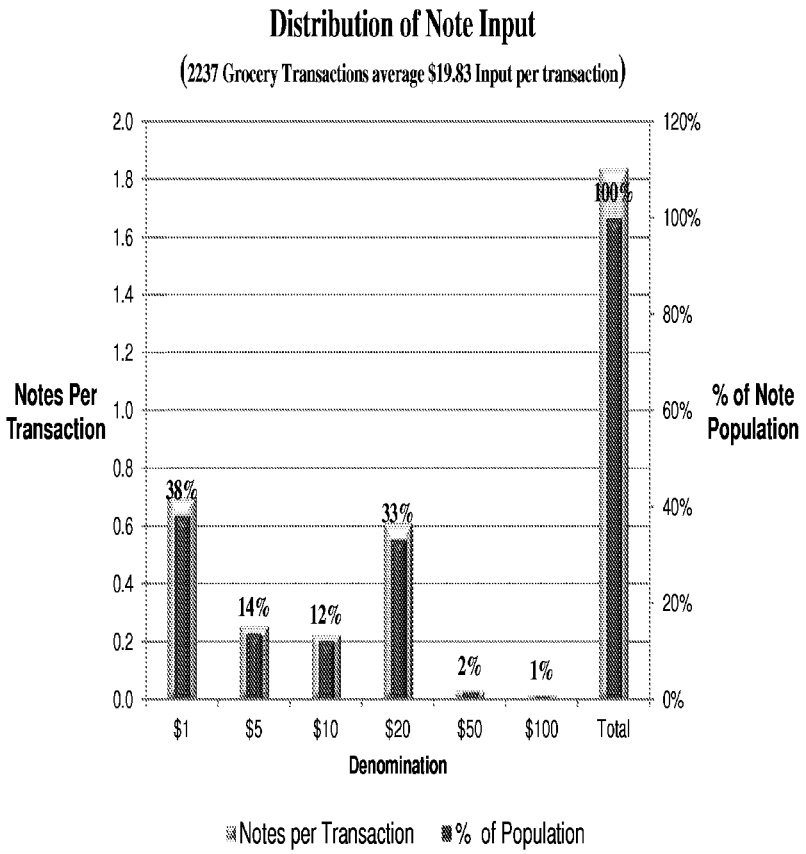
FIG. 5 is a plot illustrating a distribution of documents input by class per transaction (e.g., the document input supply) based on real data taken from a database of 2237 retail transactions.
Figure 6:
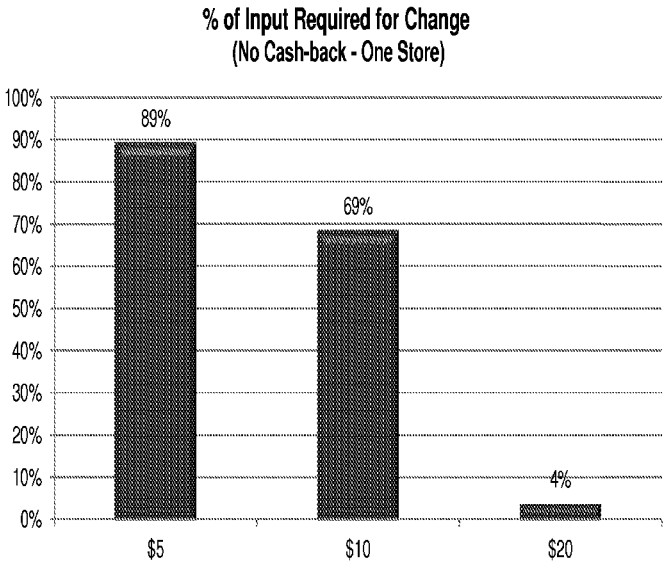
FIG. 6 is a plot illustrating the utilization of the input from FIG. 5 in recycling notes.

FIG. 5 is a plot 500 illustrating a distribution of documents input by class per transaction (e.g., the document input supply) based on real data taken from a database of 2237 retail transactions. There was no "cash-back" feature available for the retail transactions. One-dollar documents are the highest volume input at 38%; 20-dollar documents are second highest at 33%. The dominance of 20-dollar documents can be explained by automatic teller machines (ATMs) dispensing primarily 20-dollar documents. FIG. 6 is a plot 600 illustrating the utilization of the input from FIG. 5 in recycling notes. In other words, FIG. 6 illustrates the percent of input documents (e.g., the document input supply) required to satisfy output requirements (e.g., the document output demand required for change). As illustrated in FIG. 6, 89% of the $5 documents and 69% of the $10 documents input are required to make change. By comparison, only 4% of the $20 documents are required to make change.

Figure 7:
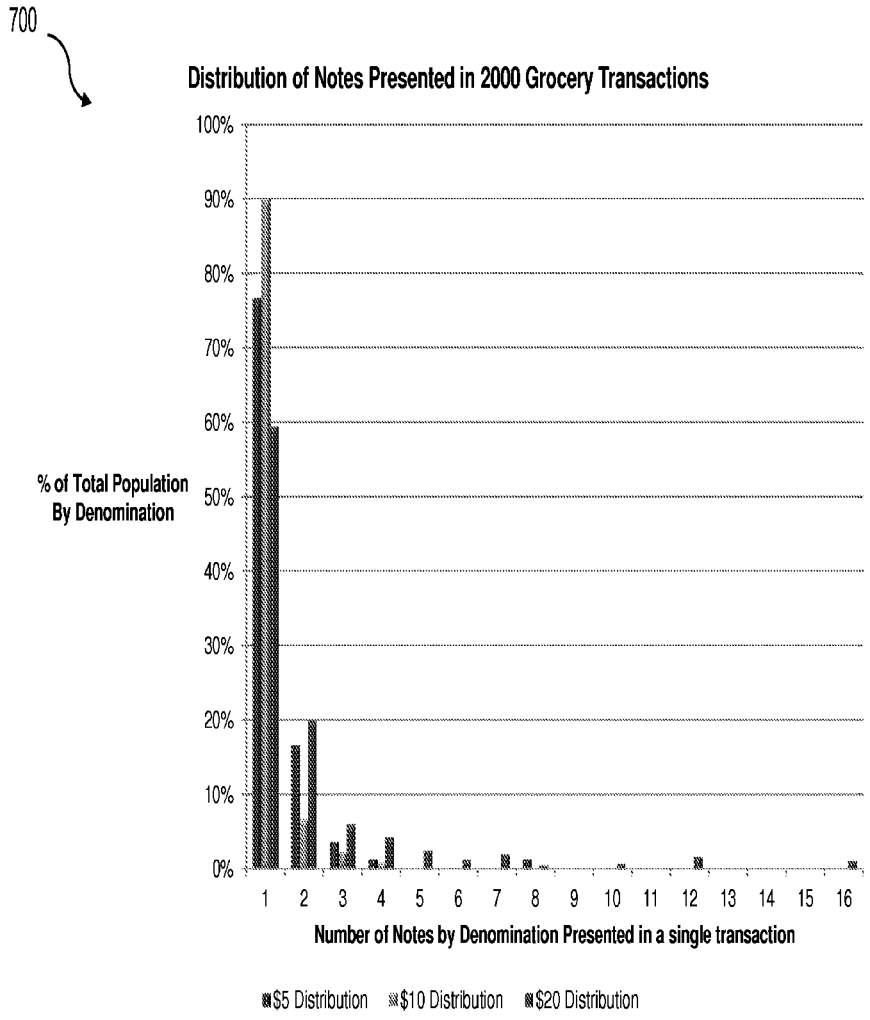
FIG. 7 is a plot illustrating the number of documents by class presented per transaction.

FIG. 7 is a plot 700 illustrating the number of documents by class presented per transaction. For example, approximately 90% of the 2237 transactions presented only one $10 document. FIG. 7 illustrates that, for most transactions, only a single document of a given class may be required for storage and/or dispensing. FIG. 8 is a chart 800 illustrating the cumulative percentages illustrated in FIG. 7. FIG. 8 illustrates the percentage of note population accepted if one or more notes are accepted per transaction. In an example implementation of a document handler 10, the chart 800 can serve as a criterion in the predetermined criteria for determining whether to store an input document in a recycler drum (e.g., 55*a* or 55*b*) or in the document cassette 60. Other criterion are possible.

Figure 9:
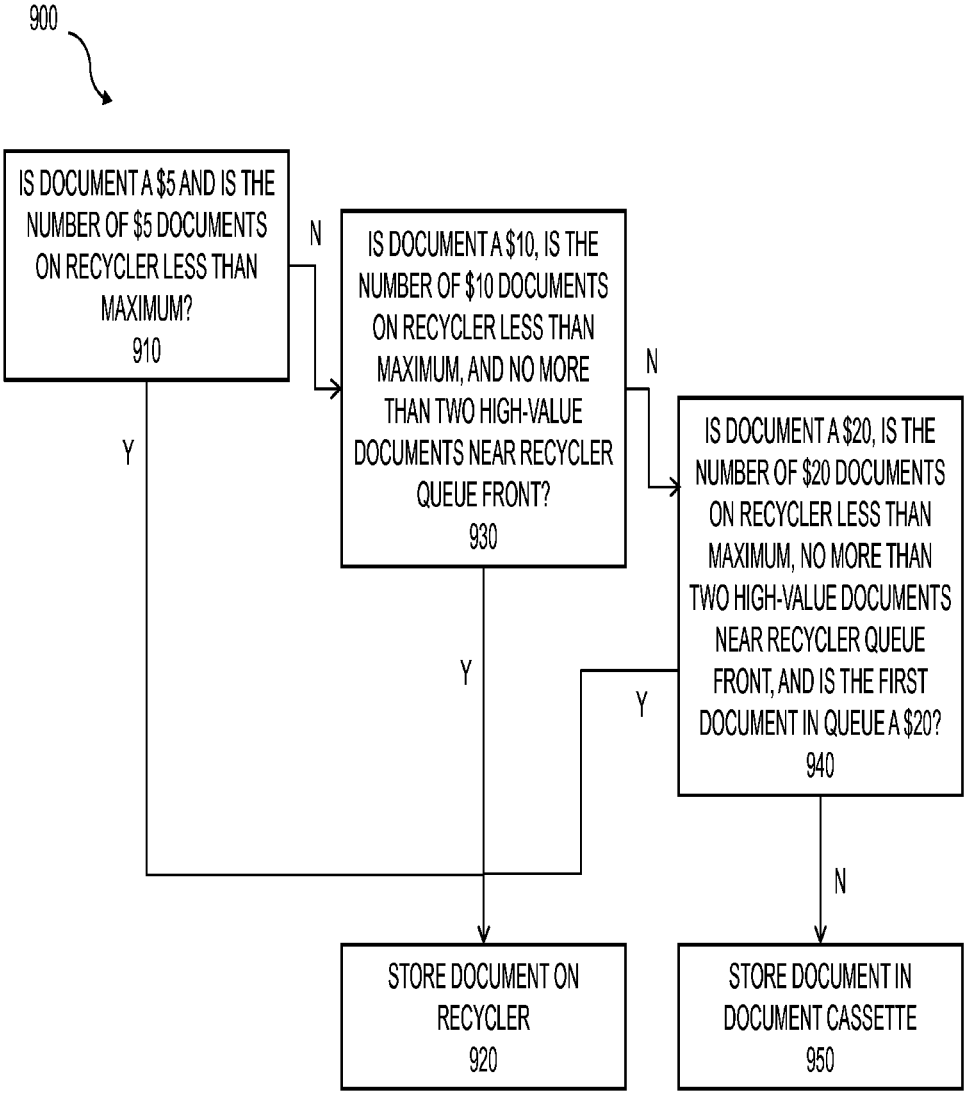
FIG. 9 is a process flow diagram illustrating an example method for managing content of an example document recycler having a LIFO queue when an input document is received and according to the predetermined criterion determined from the 2237 retail transactions.

FIG. 9 is a process flow diagram 900 illustrating an example method for managing content of an example document recycler having a LIFO queue when an input document is received and according to the predetermined criterion determined from the 2237 retail transactions. In addition, because smaller denominations are typically provided as change (e.g., as illustrated in FIG. 6), a second predetermined criterion in the example is limiting the number of $10 and $20 documents (e.g., higher denomination documents) near the front of the LIFO queue. A third criterion in the example is not including two $20 documents in order in the queue because more than one $20 documents are rarely provided as change (e.g., FIG. 6).

After an input document is received and classified, at 910, a controller can determine whether the input document is a $5 and whether the number of $5 documents currently on the recycler is less than the maximum quota for stored $5. If the input document is $5 and there is space for the $5 document, the input document, at 920, can be stored on the recycler. If the document is not a $5 document or there is not space on the recycler, at 930, the controller can determine whether the input document is a $10 document; whether the number of $10 documents currently on the recycler is less than the maximum quota for stored $10; and whether there are no more than two high value documents near the front of the queue (e.g., within the first three positions). If all these conditions are met, at 920, the input document can be stored on the recycler. If the conditions are not met, at 940, the controller can determine whether the input document is a $20 document; whether the number of $20 documents presently on the recycler is less than the maximum quota; whether there are no more than two high value documents near the front of the recycler queue (e.g., within the first three positions); and whether the document in the front of the queue is a $20 document. If these conditions are met, at 920, the document can be stored on the recycler. If these conditions are not met, at 950, the input document can be stored in the document cassette.

Figure 10:
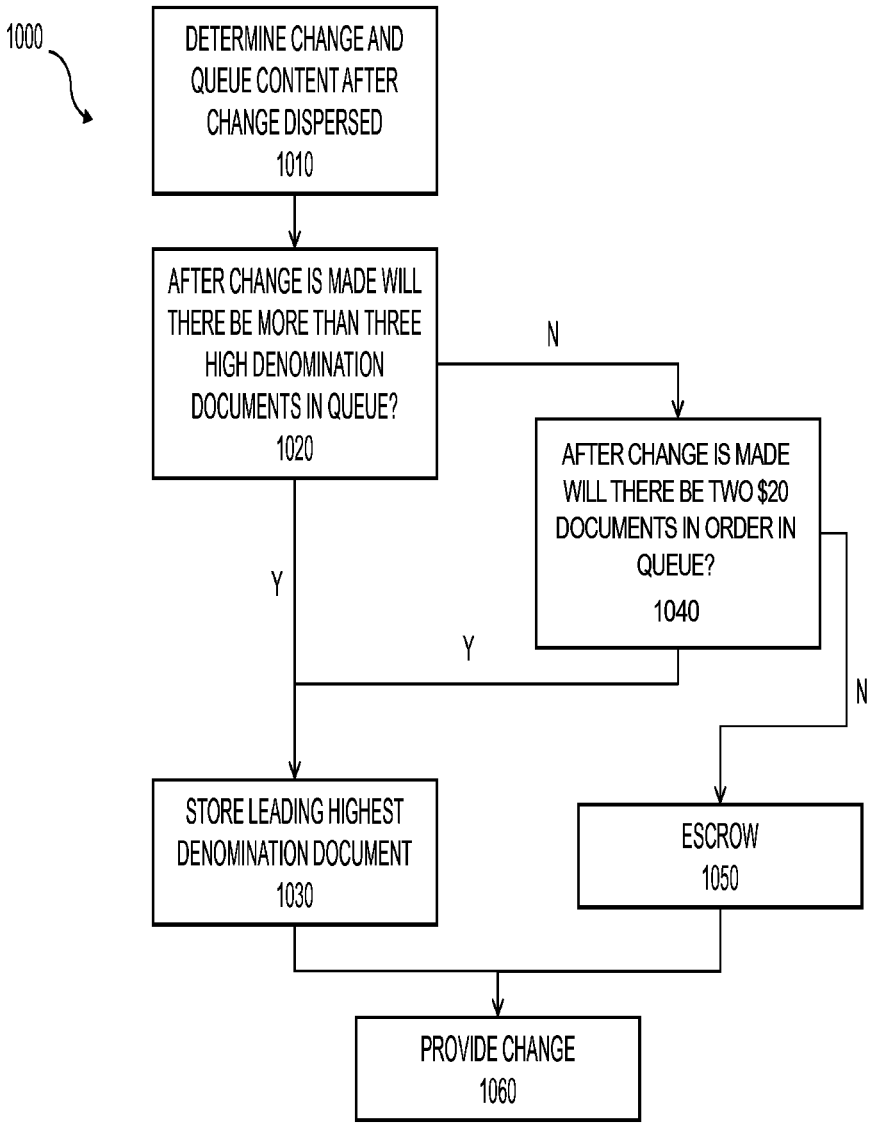
FIG. 10 is a process flow diagram illustrating a process of managing contents of a document recycler having a LIFO queue when change is required to be provided and according to the predetermined criteria discussed above with respect to FIG. 9.

FIG. 10 is a process flow diagram 1000 illustrating a process of managing contents of a document recycler having a LIFO queue when change is required to be provided and according to the predetermined criteria discussed above with respect to FIG. 9. A controller, at 1010, can determine the recycler queue state after change would be provided for a transaction. The controller, at 1020, can further determine whether providing change would result in more than three high denomination documents near the front of the recycler queue. If this condition is met, at 1030, the leading highest denomination document (e.g., a $20 document) can be stacked, for example, while change is being provided or just after change is provided. If the condition is not met, the controller, at 1040, can determine whether providing change would result in two $20 denomination documents being in order near the front of the recycler queue. If this condition is met, at 1030, the leading highest denomination document (e.g., a $20 document) can be stored in the document cassette, for example, while change is being provided or just after change is provided. If the condition is not met, at 1050, any escrow process required to provide the change can occur. At 1060, change can be provided.

While FIGS. 4-10 have illustrated an example implementation of the current subject matter using a database of 2237 retail transactions, other sources of data and/or models of user behavior can be used. For example, the 2237 retail transactions related to grocery transactions and had an average cash input of almost $20 per transaction. For a document handler operating in a different transactional environment, such as a quick service restaurant or convenience store, the value of the average purchase bundle would likely be between approximately $6 and $8, which would alter the denominations of documents seen as input. Additionally, a "cash-back" feature can be enabled that allows users to withdraw larger sums of money, which would increase the demand for larger denominations (e.g., $20). In other words, different applications, features, or transactional environments may have different document class supply and demands. The document handler 10 can manage document recycler storage units based on different criteria adapted for the particular application. The criteria can also be dynamically adjusted using adaptive learning algorithms based on the actual document input and output requirements.

The subject matter described herein provides many advantages. For example, the current subject matter can enable a self-checkout machine requiring less hardware, such as having fewer document storage recycling units. Transaction times for self-checkout machines can be reduced.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Although a few variations have been described in detail above, other modifications are possible. For example, the implementations described above can be directed to various combinations and subcombinations of the disclosed features and/or combinations and subcombinations of several further features disclosed above. In addition, the logic flows depicted in the accompanying figures and described herein do not require the particular order shown, or sequential order, to achieve desirable results. Other embodiments may be within the scope of the following claims.

What is claimed is:

1. A document handling apparatus to recycle documents, the apparatus comprising:

an authentication unit configured to categorize a received input document into a denomination class of a plurality of denomination classes;

a first recycling storage unit configured to store a plurality of input documents of different denomination classes of the plurality of denomination classes in a queue by using a two-way recycling drum;

a second recycling storage unit configured to store the received input document; and a controller configured to:

direct the received input document to one of (i) the first recycling storage unit and (ii) the second recycling storage unit based on an arrangement order of the plurality of input documents in the first recycling storage unit and the denomination class of the received input document, and control a modification of the arrangement order of the plurality of input documents in the queue of the first recycling storage unit based on a denomination class of the plurality of input documents, wherein controlling the modification of the arrangement order comprises the controller being configured to:

move a stored input document of the plurality of input documents from the first recycling storage unit to the second recycling storage unit, and return the stored input document to the first recycling storage unit, wherein, upon returning the stored input document to the first recycling storage unit, the arrangement order of the plurality of input documents of different denomination classes stored in the queue is modified.

2. The apparatus of claim 1, further comprising:

a document cassette configured to receive the plurality of input documents.

3. The apparatus of claim 1, wherein the first recycling storage unit is configured to receive and send the plurality of input documents.

4. The apparatus of claim 2, wherein the controller is configured to determine whether the received input document is stored in the document cassette or the first recycling storage unit after the received input document is received by the authentication unit.

5. The apparatus of claim 1, wherein the controller is configured to control the modification of the arrangement order of at least a first stored input document and a second stored input document in the first recycling storage unit as a function of a denomination class of the first stored input document and a denomination class of the second stored input document.

6. The apparatus of claim 5, wherein the controller is configured to control the modification of the arrangement order of at least the first stored input document and the second stored input document after the received input document is received by the authentication unit.

7. The apparatus of claim 1, wherein the controller is configured to control the modification of the arrangement order of the plurality of input documents in the first recycling storage unit as a function of a present arrangement of the plurality of input documents and a set of criteria.

8. The apparatus of claim 7, wherein the controller is configured to define the set of criteria as a function of historical transaction data of the apparatus and historical data of receptions and transmissions of input documents over a period of time.

9. The apparatus of claim 1, further comprising:

a transportation unit coupled to the authentication unit, the second recycling storage unit, and the first recycling storage unit, and wherein the transportation unit is configured to:

transport one or more of the plurality of input documents between the authentication unit and at least one of the first recycling storage unit and the second recycling storage unit, and transport one or more of the plurality of input documents between the first recycling storage unit and the second recycling storage unit.

10. A document handling apparatus to recycle documents, the apparatus comprising:

an authentication unit configured to categorize a received input document into a denomination class of a plurality of denomination classes;

a first recycling storage unit configured to store a plurality of input documents of different denomination classes of the plurality of denomination classes in a queue by using a two-way recycling drum;

a document cassette configured to store the received input document; and a controller configured to:

direct the received input document to one of (i) the document cassette and (ii) the first recycling storage unit based on an arrangement order of the plurality of input documents in the first recycling storage unit and the denomination class of the received input document, and control a modification of the arrangement order of the plurality of input documents in the queue of the first recycling storage unit based on a denomination class of the plurality of input documents, wherein controlling the modification of the arrangement order comprises the controller being configured to:

remove a stored input document of the plurality of input documents from the first recycling storage unit, and return the stored input document to the first recycling storage unit in a different arrangement order, wherein, upon returning the stored input document to the first recycling storage unit, the arrangement order of the plurality of input documents of different denomination classes stored in the queue is modified.

11. The apparatus of claim 10, further comprising:

wherein modifying the arrangement order of the plurality of input documents on the first recycling storage unit comprises transporting one or more of the plurality of input documents between one of the first recycling storage unit and a second recycling storage unit, the first recycling storage unit and the document cassette, and the second recycling storage unit and the document cassette.

12. The apparatus of claim 10, wherein the first recycling storage unit is configured to receive and send the plurality of input documents, and wherein the document cassette is configured to only receive the plurality of input documents.

13. The apparatus of claim 10, wherein the controller is configured to modify the arrangement order of the plurality of input documents in the first recycling storage unit as a function of a present arrangement of the documents and a predefined set of criteria.

14. A method comprising:

receiving an input document including a denomination class of a plurality of denomination classes;

transporting the input document to one of (i) a first recycling storage unit and (ii) a second recycling storage unit as a function of an arrangement order of a plurality of stored input documents in the first recycling storage unit and the denomination class of the input document, wherein the first recycling storage unit stores the plurality of stored input documents in a queue by using a two-way recycling drum, and wherein the plurality of stored input documents is of different denomination classes of the plurality of denomination classes; and controlling a modification of the arrangement order of the plurality of stored input documents in the first recycling storage unit based on a denomination class of the plurality of stored input documents, wherein controlling the modification of the arrangement order comprises:

moving a stored input document of the plurality of stored input documents from the first recycling storage unit to the second recycling storage unit, and returning the input document to the first recycling storage unit, wherein, upon returning the stored input document to the first recycling storage unit, the arrangement order of the plurality of stored input documents of the different denomination classes stored in the queue is modified.

15. The method of claim 14, wherein one or more of the plurality of input documents is transported to one of the first recycling storage unit and the second recycling storage unit after receiving the input document.

16. The method claim 14, further comprising:

storing the plurality of stored input documents in a last-in-first-out (LIFO) queue in the first recycling storage unit, and modifying the arrangement order of at least a first stored document and a second stored document in the first recycling storage unit as a function of a denomination class of the first stored document and a denomination class of the second stored document.

17. The method of claim 14, wherein the arrangement order of the plurality of stored input documents in the first recycling storage unit is determined as a function of historical data of receptions and transmissions of document by the first recycling storage unit over a period of time.

18. The method of claim 15, wherein transporting the input document comprises transporting the input document to one of a document cassette, the first recycling storage unit, and the second recycling storage unit as a function of the denomination class of the input document and the arrangement order of the plurality of stored input documents in the first recycling storage unit and the second recycling storage unit.

* * * * *